US007466268B2

(12) United States Patent
Chen

(10) Patent No.: US 7,466,268 B2
(45) Date of Patent: Dec. 16, 2008

(54) FREQUENCY ADJUSTABLE ANTENNA APPARATUS AND A MANUFACTURING METHOD THEREOF

(75) Inventor: Chih-Ming Chen, Hsinchu (TW)

(73) Assignee: Inpaq Technology Co., Ltd., Hsinshu (TW)

( * ) Notice: Subject to any disclaimer, the term of this patent is extended or adjusted under 35 U.S.C. 154(b) by 371 days.

(21) Appl. No.: 11/480,945

(22) Filed: Jul. 6, 2006

(65) Prior Publication Data

US 2008/0007463 A1 Jan. 10, 2008

(51) Int. Cl.
*H01Q 1/38* (2006.01)

(52) U.S. Cl. ..... 343/700 MS; 343/702; 343/895

(58) Field of Classification Search ..... 343/700 MS, 343/702, 895, 906, 873
See application file for complete search history.

(56) References Cited

U.S. PATENT DOCUMENTS 6,480,171 B1 * 11/2002 Huang ..... 343/860
2002/0149538 A1 * 10/2002 Tomomatsu et al. ..... 343/895
2004/0130495 A1 * 7/2004 Hilgers ..... 343/702
2006/0109192 A1 * 5/2006 Weigand ..... 343/795
2006/0256018 A1 * 11/2006 Soler Castany et al. ..... 343/700 MS

* cited by examiner

*Primary Examiner*—HoangAnh T Le
(74) *Attorney, Agent, or Firm*—Rosenberg, Klein & Lee

(57) ABSTRACT

A frequency adjustable antenna apparatus and a manufacturing method thereof are disclosed. The antenna apparatus includes a plurality of antenna paths and the length of the antenna path is changed via the soldering pads. Therefore, the receiving frequency of the antenna can be changed. The frequency adjustable antenna apparatus includes a body, a first path, at least one second path and a printed circuit board. The first path is located on an upper surface of the body and extends to a lower surface. The second path is located on the lower surface. The printed circuit board includes at least one soldering pad. When the lower surface of the body is pasted on the printed circuit board, the first path is connected with the second path via the soldering pads. Thereby, the length of the first path is changed to adjust the frequency of the antenna apparatus.

24 Claims, 4 Drawing Sheets

FREQUENCY ADJUSTABLE ANTENNA APPARATUS AND A MANUFACTURING METHOD THEREOF

BACKGROUND OF THE INVENTION

1. Field of the Invention

The present invention relates to a frequency adjustable antenna apparatus and a manufacturing method thereof. In particular, this invention relates to a frequency adjustable antenna apparatus and a manufacturing method thereof that adjusts the length of the antenna path to change the frequency of the antenna.

2. Description of the Related Art

Due to the development of wireless communication technology, products adopting wireless communication technology, such as cell phones, blue-tooth cell phones, and wireless Internet devices etc., have become commonplace. A common wireless communication system includes a global system for mobile communication (GSM), code division multiple access (CDMA), $3^{rd}$ generation cell phone (3G) and blue-tooth communication, etc. The communication frequency applied in these system includes 900 MHz, 1800 MHz, 1900 MHz and 2.4 GHz etc. The antenna installed to the wireless communication device affects the effect of receiving signal. Therefore, a variety of antennas have been developed.

Because each of the wireless communication systems uses different frequency, the antenna of the wireless communication system is also different. In order to match the communication frequency of the wireless communication system, the antenna is designed according to the communication frequency of the wireless communication system. The antenna may be a built-in type or an external type. The supporting frequency of the antenna may be single, dual or a multi-frequency one.

However, in order to support the communication frequency of the wireless communication system, an antenna has been developed that only belongs to the single wireless communication system. Therefore, if the designer wants to support all wireless communication systems, a lot of antennas are necessary. This causes the developing time to be lengthened and the cost of the antenna is also increased.

SUMMARY OF THE INVENTION

One particular aspect of the present invention is to provide a frequency adjustable antenna apparatus and a manufacturing method thereof. The present invention adjusts the length of the antenna path to change the frequency of the antenna.

Another particular aspect of the present invention is to provide a frequency adjustable antenna apparatus and a manufacturing method thereof. The antenna apparatus includes a plurality of antenna paths and the length of the antenna path is changed via the soldering pads on the printed circuit board. Therefore, the receiving frequency of the antenna is also changed.

A further particular aspect of the present invention is to provide a frequency adjustable antenna apparatus and a manufacturing method thereof. The present invention adjusts the length of the antenna path to change the frequency of the antenna. Via an improved proper design, the frequency adjustable antenna apparatus can be a single or dual frequency antenna.

A further particular aspect of the present invention is to provide a frequency adjustable antenna apparatus and a manufacturing method thereof. The antenna apparatus includes a plurality of antenna paths and the length of the antenna path is changed via the soldering pads on the printed circuit board. Therefore, the receiving frequency of the antenna is also changed. Furthermore, the reliability of the plurality of antenna paths attached onto the body is enhanced via auxiliary paths.

The frequency adjustable antenna apparatus of the present invention includes a body, a first path, at least one second path and a printed circuit board. The first path is located on an upper surface of the body and extends to a lower surface. The at least one second path is located on the lower surface of the body. The printed circuit board includes at least one soldering pad. When the lower surface of the body is pasted on the printed circuit board, the first path is connected with the second path via the soldering pads of the printed circuit board. Thereby, the length of the first path of the antenna apparatus is changed to adjust the frequency of the antenna apparatus.

The frequency adjustable antenna apparatus of the present invention includes a body, a first path, at least one second path, a third path and a printed circuit board. The first path is located on an upper surface of the body and extends to a lower surface. The at least one second path is located on the lower surface of the body and the third path is also located on the lower surface of the body. The printed circuit board includes at least one soldering pad. When the lower surface of the body is pasted on the printed circuit board, the first path provides a first frequency and the third path provides a second frequency. The first path is connected with the second path and/or the third path is connected with the second path via the soldering pads of the printed circuit board. Thereby, the length of the first path and/or the length of the third path of the antenna apparatus are changed to adjust the frequency of the antenna apparatus. Therefore, a dual-frequency frequency adjustable antenna apparatus is provided.

The frequency adjustable antenna apparatus of the present invention includes a body, a plurality of paths, and a printed circuit board. The plurality of paths are located on an upper surface and a lower surface of the body. The printed circuit board includes at least one soldering pad. When the lower surface of the body is pasted on the printed circuit board, some of the plurality of paths are connected together via the soldering pads of the printed circuit board. Thereby, the length of the antenna path of the antenna apparatus is changed to adjust the frequency of the antenna apparatus.

The present invention also provides a manufacturing method for a frequency adjustable antenna apparatus. The steps includes: (1) manufacturing a body; (2) disposing a plurality of paths on the body, and the plurality of paths are disposed on an upper surface and a lower surface of the body; (3) manufacturing a printed circuit board, and there are a plurality of soldering pads on the printed circuit board and the plurality of soldering pads are located on the locations that correspond to the ends of the plurality of paths. When the lower surface of the body is pasted on the printed circuit board, some of the plurality of paths are connected together via the soldering pads of the printed circuit board. Thereby, the length of the antenna path of the antenna apparatus is changed to adjust the frequency of the antenna apparatus.

For further understanding of the invention, reference is made to the following detailed description illustrating the embodiments and examples of the invention. The description is only for illustrating the invention and is not intended to be considered limiting of the scope of the claim.

BRIEF DESCRIPTION OF THE DRAWINGS

The drawings included herein provide a further understanding of the invention. A brief introduction of the drawings is as follows.

DETAILED DESCRIPTION OF THE PREFERRED EMBODIMENTS

Figure 1A:
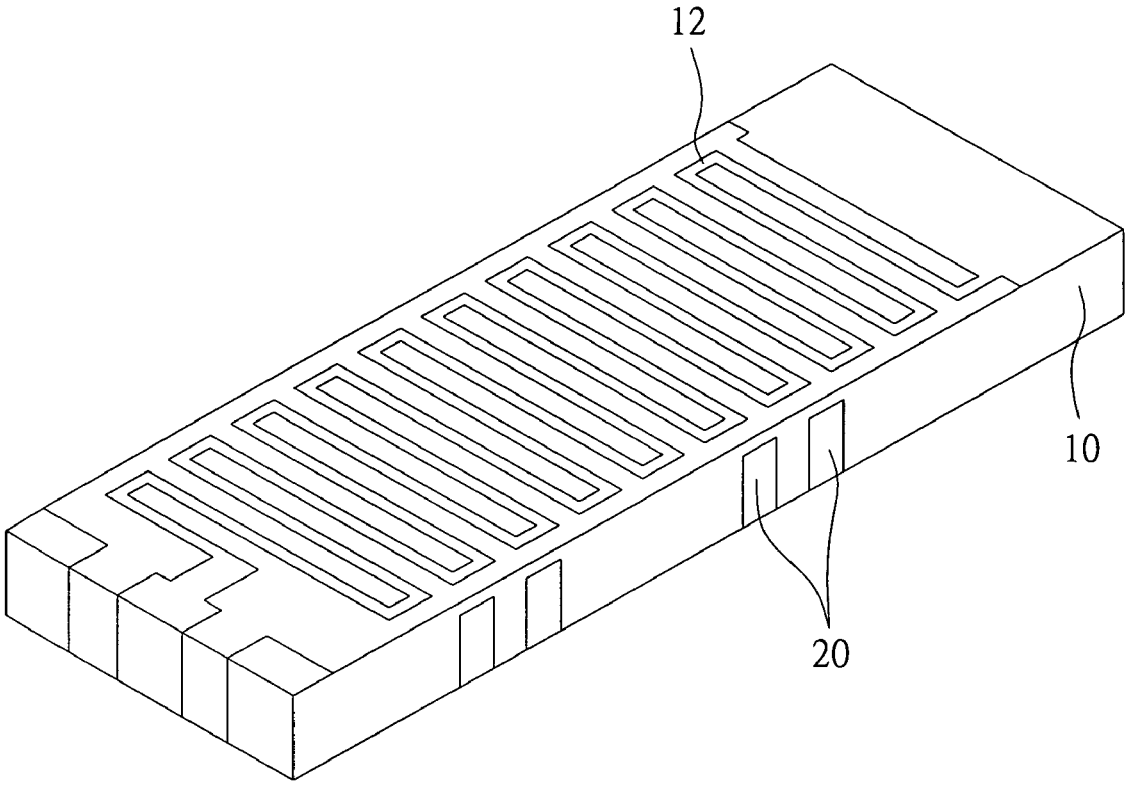
FIG. 1A is a schematic diagram of the frequency adjustable antenna apparatus of the first embodiment of the present invention.
Figure 1B:
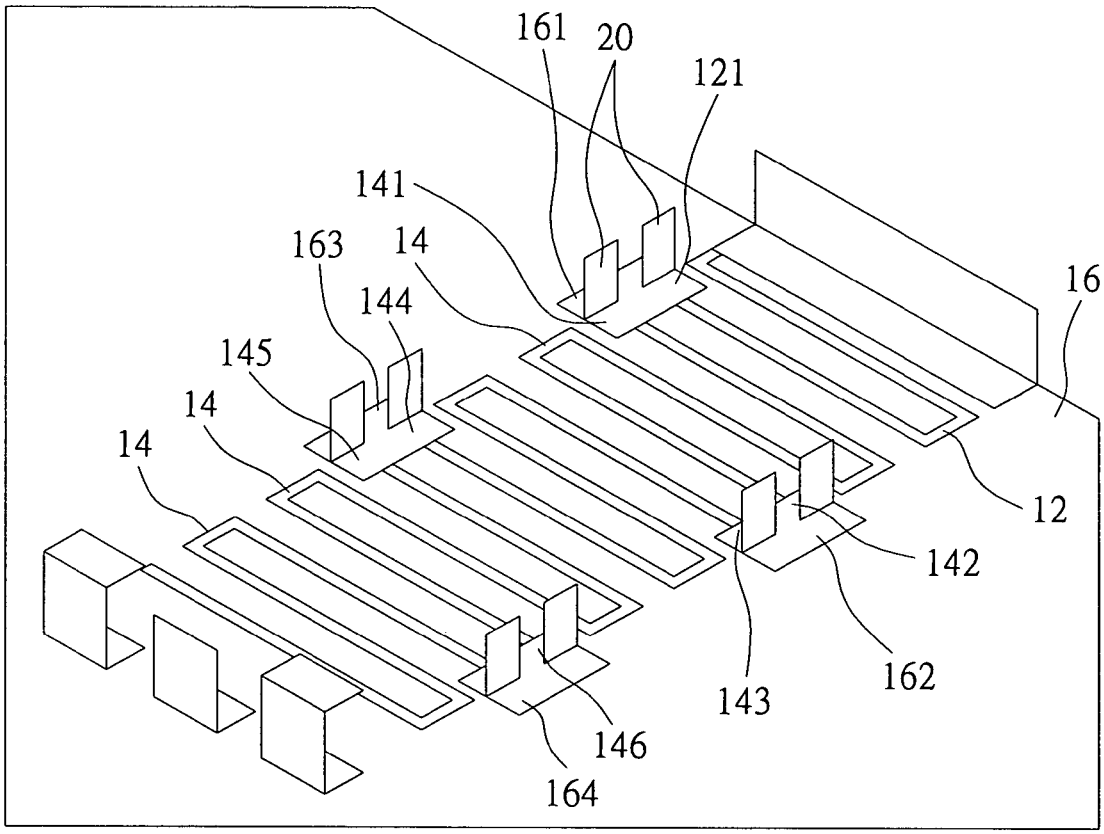
FIG. 1B is a schematic diagram of the frequency adjustable antenna apparatus of the first embodiment of the present invention connected with the printed circuit board.

Please refer to FIGS. 1A and 1B, which show a schematic diagram of the frequency adjustable antenna apparatus of the first embodiment of the present invention and a schematic diagram of the antenna paths connected with a printed circuit board. The frequency adjustable antenna apparatus of the present invention includes a body 10, a first path 12, at least one second path 14 and a printed circuit board 16. The first path 12 is located on an upper surface of the body 10 and extends to a lower surface. The at least one second path 14 is located on the lower surface of the body 10. The printed circuit board 16 includes at least one soldering pad, such as soldering pads 161, 162, 163 and 164. When the lower surface of the body 10 is pasted on the printed circuit board 16, the first path 12 is connected with the second path 14 via the soldering pad 161 of the printed circuit board 16. Thereby, the length of the first path 12 of the antenna apparatus is changed to adjust the frequency of the antenna apparatus.

For example, when the soldering pad 161 of the printed circuit board 16 is not being used for connecting the first path 12 to the second path 14, the path length of the antenna apparatus only extends to the end point 121 (as shown in the figure) and the frequency of the antenna apparatus is 2.4 GHz. When the soldering pad 161 of the printed circuit board 16 is being used for connecting the end point 121 of the first path 12 to the end point 141 of the second path 14, the path length of the antenna apparatus extends to the end point 142 (as shown in the figure) and the frequency of the antenna apparatus is 1.9 GHz. In the same way, when the soldering pad 162 of the printed circuit board 16 is being used for connecting the end point 142 to the end point 143, the path length of the antenna apparatus extends to the end point 144 (as shown in the figure) and the frequency of the antenna apparatus is 1.8 GHz. When the soldering pad 163 of the printed circuit board 16 is being used for connecting the end point 144 to the end point 145, the path length of the antenna apparatus extends to the end point 146 (as shown in the figure) and the frequency of the antenna apparatus is 1.7 GHz. According to the relation between the frequency and the path length of the antenna, the path length of the antenna is changed by the addition of the soldering pad on the printed circuit board 16 and the frequency of the antenna is modified to produce a frequency adjustable antenna apparatus. However, the above frequencies are only used for illustrating the principle of the present invention and they can be any reasonable frequency.

The body 10 is made of ceramic. The first path 12 and the second path 14 are pasted on the body 10 by a printing method. Moreover, in order to increase the effect of pasting the antenna to the body 10, at least one auxiliary path 20 is located at the end point 121 of the first path 12 and the end points 141, 142, 143, 144, 145 and 146 of the second path 14. The auxiliary path 20 is pasted on the side surface of the body 10 to enhance the effect of pasting the first path 12 and the second path 14 on the body 10. The auxiliary path 20 is pasted on the body 10 by a soldering method.

Alternatively, the arrangement of the antenna path of the frequency adjustable antenna apparatus of the present invention can be implemented by the following method. The difference to the first embodiment is that the first path 12 is only disposed on the upper surface of the body 10, and the second path 14 begins from the upper surface of the body 10 and extends to the lower surface of the body 10. A path extends from the end points of the first path 12 and the second path 14 disposed on the upper surface of the body 10 to the lower surface of the body 10 along the side surface of the body 10. Therefore, when the lower surface of the body 10 is pasted on the printed circuit board 16, the first path 12 is connected with the second path 14 via the soldering pad 161 of the printed circuit board 16. Thereby, the length of the first path 12 of the antenna apparatus is changed and the frequency of the antenna apparatus is modified. According to the relation between the frequency and the path length of the antenna, the path length of the antenna is changed by the addition of the soldering pad on the printed circuit board 16 and the frequency of the antenna is modified to produce a frequency adjustable antenna apparatus.

Figure 2A:
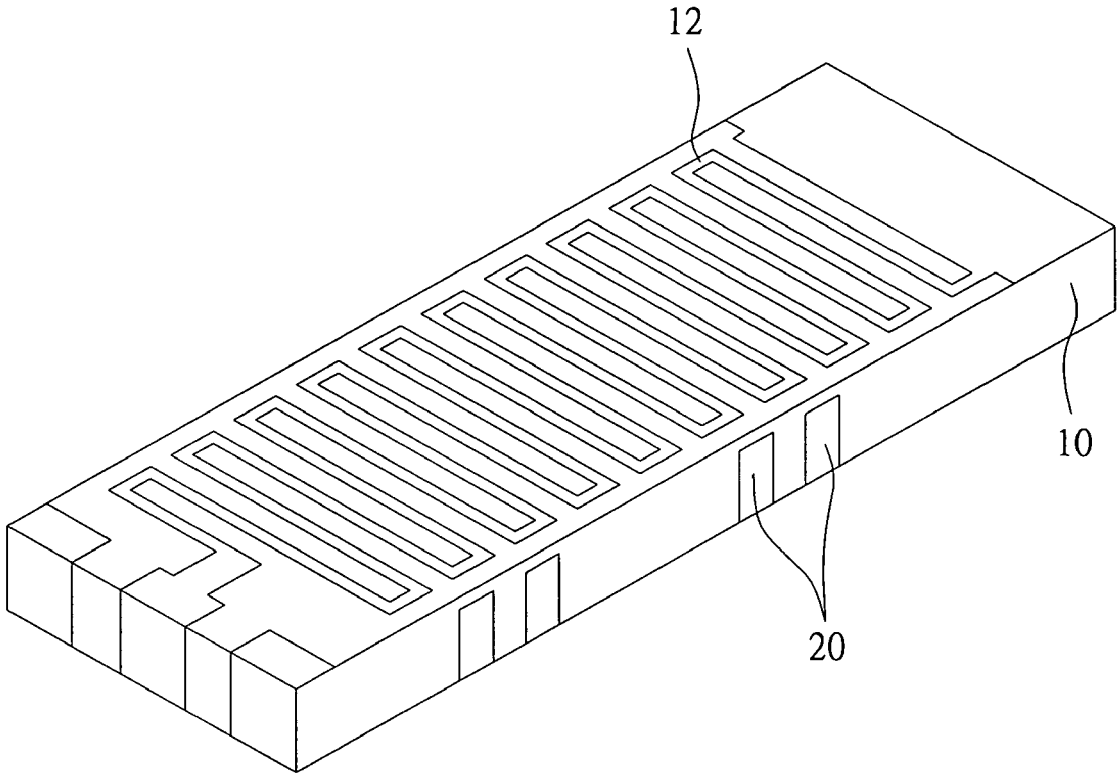
FIG. 2A is a schematic diagram of the frequency adjustable antenna apparatus of the second embodiment of the present invention.
Figure 2B:
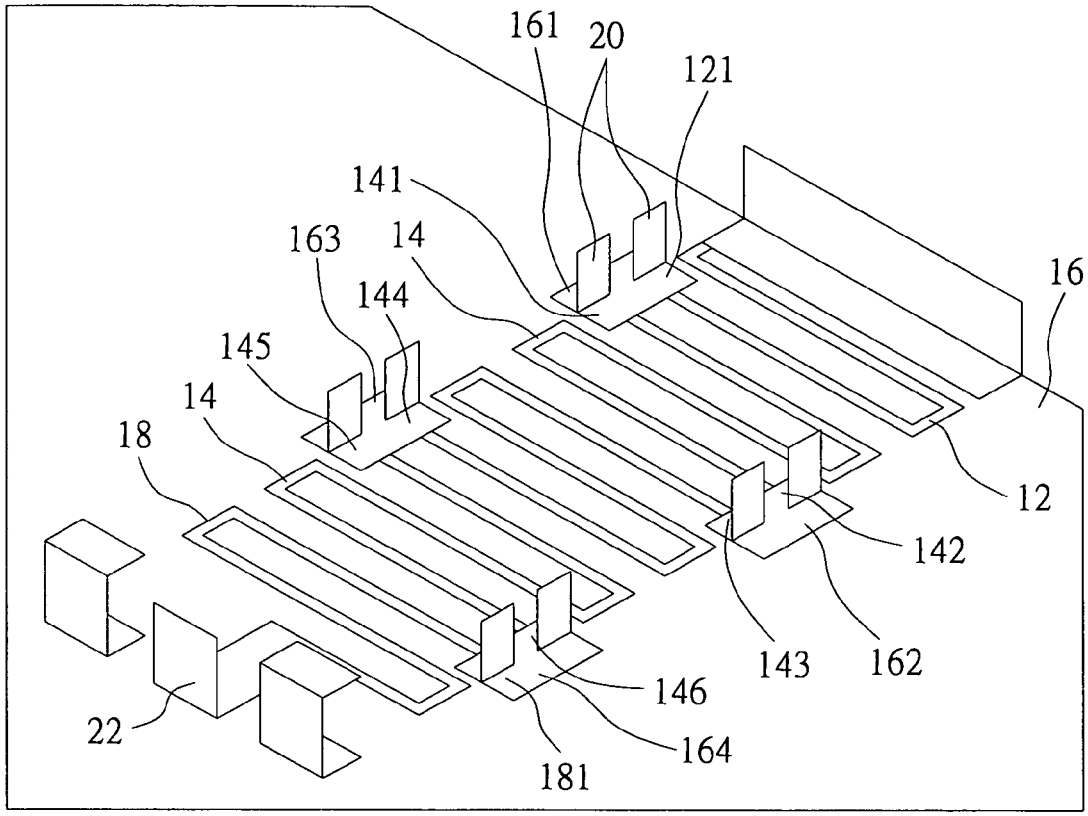
FIG. 2B is a schematic diagram of the frequency adjustable antenna apparatus of the second embodiment of the present invention connected with the printed circuit board.

Please refer to FIGS. 2A and 2B, which show a schematic diagram of the frequency adjustable antenna apparatus of the second embodiment of the present invention and a schematic diagram of the antenna paths connected with a printed circuit board. The frequency adjustable antenna apparatus of the present invention includes a body 10, a first path 12, at least one second path 14, a third path 18 and a printed circuit board 16. The first path 12 is located on an upper surface of the body 10 and extends to a lower surface. The at least one second path 14 is located on the lower surface of the body 10 and the third path 18 is also located on the lower surface of the body 10. The printed circuit board 16 includes a plurality of soldering pads 161, 162, 163, and 164. When the lower surface of the body 10 is pasted on the printed circuit board 16, the first path 12 is connected with the second path 14 and/or the third path 18 is connected with the second path 14 via the soldering pads 161 and/or 164 of the printed circuit board 16. Thereby, the length of the first path 12 and/or the length of the third path 18 of the antenna apparatus are changed to adjust the frequency of the antenna apparatus.

For example, when the soldering pad 161 of the printed circuit board 16 is not being used for connecting the first path 12 to the second path 14 and the soldering pad 164 of the printed circuit board 16 is not being used for connecting the third path 12 to the second path 14, the length of the first path 12 of the antenna apparatus only extends to the end point 121 (as shown in the figure) to provide a first frequency. The length of the third path 18 of the antenna apparatus only extends to the end point 181 (as shown in the figure) and a second frequency is provided from the input point 22 to the end point 181. When the soldering pad 161 of the printed circuit board 16 is being used for connecting the end point 121 of the first path 12 to the end point 141 of the second path 14, the path length of the antenna apparatus extends to the end point 142 to provide a third frequency. In the same way, when the soldering pad 164 of the printed circuit board 16 is being used for connecting the end point 181 to the end point 146, the path length of the second frequency extends to the end point 145 (as shown in the figure) and the frequency of the antenna apparatus is changed to a fourth frequency. According to the relation between the frequency and the path length of the antenna, the path length of the antenna is changed by the addition of the soldering pad on the printed circuit board 16 and the frequency of the antenna is modified to produce a dual-frequency frequency adjustable antenna apparatus.

The body 10 is made of ceramic. The first path 12, the second path 14 and the third path 18 are pasted on the body 10 by a printing method. Moreover, in order to increase the effect of pasting the antenna path to the body 10, at least one auxiliary path 20 is located at the end point 121 of the first path 12, the end points 141, 142, 143, 144, 145 and 146 of the second path 14 and the end point 181 of the third path 18. The auxiliary path 20 is pasted on the side surface of the body 10 to enhance the effect of pasting the first path 12, the second path 14 and the third path 18 on the body 10. The auxiliary path 20 is pasted on the body 10 by a soldering method.

The present invention also provides a manufacturing method for a frequency adjustable antenna apparatus. The steps includes: (1) manufacturing a body made of ceramic; (2) disposing a plurality of paths on the body; the plurality of paths are disposed on an upper surface and a lower surface of the body; (3) manufacturing a printed circuit board; there are a plurality of soldering pads on the printed circuit board and the plurality of soldering pads are located on the locations that correspond to the ends of the plurality of paths. When the lower surface of the body is pasted on the printed circuit board, some of the plurality of paths are connected together via the soldering pads of the printed circuit board. Thereby, the length of the antenna path of the antenna apparatus is changed and the frequency of the antenna apparatus is modified. In order to increase the effect of pasting the plurality of paths to the body, at least one auxiliary path is manufactured to connect the end points of the plurality of paths and is pasted on the side surface of the body to enhance the effect of pasting the plurality of paths on the body.

The frequency adjustable antenna apparatus and a manufacturing method thereof of the present invention has the following characteristics:

1. The present invention adjusts the length of the antenna path to change the frequency of the antenna apparatus. Therefore, the frequency adjustable antenna apparatus of the present invention can be applied to a variety of communication frequencies. The development time is thereby reduced.

2. The present invention installs a plurality of auxiliary paths on the side surface of the body to enhance the effect of pasting the antenna paths on the body. Therefore, the reliability of the product is enhanced.

3. The frequency adjustable antenna apparatus of the present invention has a dual-frequency function.

The description above only illustrates specific embodiments and examples of the invention. The invention should therefore cover various modifications and variations made to the herein-described structure and operations of the invention, provided they fall within the scope of the invention as defined in the following appended claims.

What is claimed is:

1. A frequency adjustable antenna apparatus, comprising:
a body;
a first path located on an upper surface of the body and extending to a lower surface;
at least one second path located on the lower surface of the body; and
a printed circuit board having at least one soldering pad;
wherein, when the lower surface of the body is pasted on the printed circuit board, the first path is connected with the second path via the soldering pads of the printed circuit board;
wherein the length of the first path of the antenna apparatus is changed to adjust the frequency of the antenna apparatus.

2. The frequency adjustable antenna apparatus as claimed in claim 1, wherein the body is made of ceramic.

3. The frequency adjustable antenna apparatus as claimed in claim 1, further comprising at least one auxiliary path connected with the first path and the second path and pasted on the side surface of the body in order to enhance the effect of pasting the first path and the second path on the body.

4. The frequency adjustable antenna apparatus as claimed in claim 1, wherein the frequency of the frequency adjustable antenna apparatus is 1.7 GHz, 1.8 GHz, 1.9 GHz, or 2.4 GHz.

5. The frequency adjustable antenna apparatus as claimed in claim 1, wherein the first path and the second path are pasted on the body by a printing method.

6. The frequency adjustable antenna apparatus as claimed in claim 3, wherein the auxiliary path is pasted on the body by a welding method.

7. A frequency adjustable antenna apparatus, comprising:
a body;
a first path located on an upper surface of the body and extending to a lower surface;
at least one second path located on the lower surface of the body;
a third path located on the lower surface of the body; and
a printed circuit board having at least one soldering pad;
wherein, when the lower surface of the body is pasted on the printed circuit board, the first path provides a first frequency and the third path provides a second frequency, and the first path is connected with the second path and/or the third path is connected with the second path via the soldering pads of the printed circuit board;
wherein the length of the first path and/or the third path of the antenna apparatus is changed to adjust the frequency of the antenna apparatus to provide a dual-frequency frequency adjustable antenna apparatus.

8. The frequency adjustable antenna apparatus as claimed in claim 7, wherein the body is made of ceramic.

9. The frequency adjustable antenna apparatus as claimed in claim 7, further comprising at least one auxiliary path connected with the first path, the second path and the third path, and pasted on the side surface of the body in order to enhance the effect of pasting the first path, the second path and the third path on the body.

10. The frequency adjustable antenna apparatus as claimed in claim 7, wherein the frequency of the frequency adjustable antenna apparatus is 1.7 GHz, 1.8 GHz, 1.9 GHz, or 2.4 GHz.

11. The frequency adjustable antenna apparatus as claimed in claim 7, wherein the first path, the second path and the third path are pasted on the body by a printing method.

12. The frequency adjustable antenna apparatus as claimed in claim 9, wherein the auxiliary path is pasted on the body by a welding method.

13. A frequency adjustable antenna apparatus, comprising:
a body;
a plurality of paths located on an upper surface and a lower surface of the body;
a printed circuit board having at least one soldering pad;
wherein, when the lower surface of the body is pasted on the printed circuit board, the plurality of paths are connected together via the soldering pads of the printed circuit board;

wherein the length of the paths of the antenna apparatus are changed to adjust the frequency of the antenna apparatus.

14. The frequency adjustable antenna apparatus as claimed in claim 13, wherein the body is made of ceramic.

15. The frequency adjustable antenna apparatus as claimed in claim 13, further comprising at least one auxiliary path connected with the plurality of paths and pasted on the side surface of the body in order to enhance the effect of pasting the plurality of paths on the body.

16. The frequency adjustable antenna apparatus as claimed in claim 13, wherein the frequency of the frequency adjustable antenna apparatus is 1.7 GHz, 1.8 GHz, 1.9 GHz, or 2.4 GHz.

17. The frequency adjustable antenna apparatus as claimed in claim 13, wherein the plurality of paths are pasted on the body by a printing method.

18. The frequency adjustable antenna apparatus as claimed in claim 15, wherein the auxiliary path is pasted on the body by a welding method.

19. A manufacturing method for a frequency adjustable antenna apparatus, the steps comprising;

manufacturing a body;

disposing a plurality of paths on the body; wherein the plurality of paths are disposed on an upper surface and a lower surface of the body; and manufacturing a printed circuit board; wherein there are a plurality of soldering pads on the printed circuit board and the plurality of soldering pads are located on the locations that correspond to the ends of the plurality of paths;

wherein, when the lower surface of the body is pasted on the printed circuit board, some of the plurality of paths are connected together via the soldering pads of the printed circuit board wherein the length of the antenna path of the antenna apparatus is changed to adjust the frequency of the antenna apparatus.

20. The manufacturing method for a frequency adjustable antenna apparatus as claimed in claim 19, wherein the body is made of ceramic.

21. The manufacturing method for a frequency adjustable antenna apparatus as claimed in claim 19, further comprising at least one auxiliary path connected with the plurality of paths and pasted on the side surface of the body in order to enhance the effect of pasting the plurality of paths on the body.

22. The manufacturing method for a frequency adjustable antenna apparatus as claimed in claim 19, wherein the frequency of the frequency adjustable antenna apparatus is 1.7 GHz, 1.8 GHz, 1.9 GHz, or 2.4 GHz.

23. The manufacturing method for a frequency adjustable antenna apparatus as claimed in claim 19, wherein the plurality of paths are pasted on the body by a printing method.

24. The manufacturing method for a frequency adjustable antenna apparatus as claimed in claim 21, wherein the auxiliary path is pasted on the body by a welding method.

* * * * *